United States Patent [19]

Knoop

[11] Patent Number: 4,697,293

[45] Date of Patent: Oct. 6, 1987

[54] PRESSURE SENSING AUTOMATIC WATER LEVEL CONTROL

[75] Inventor: Donald E. Knoop, Royalton Township, Berrien County, Mich.

[73] Assignee: Whirlpool Corporation, Benton Harbor, Mich.

[21] Appl. No.: 815,403

[22] Filed: Dec. 31, 1985

[51] Int. Cl.[4] ..... D06F 33/08

[52] U.S. Cl. ..... 8/158; 8/159; 68/12 R; 68/207; 137/387

[58] Field of Search ..... 8/158, 159; 68/12 R, 68/207; 137/387

[56] References Cited

U.S. PATENT DOCUMENTS

| | | | |
|---|---|---|---|
| 3,030,790 | 4/1962 | Davenport et al. . | |
| 3,065,618 | 11/1962 | Cobb et al. . | |
| 3,086,836 | 4/1963 | Ohmann . | |
| 3,093,841 | 6/1963 | Cobb et al. . | |
| 3,359,766 | 12/1967 | Haas | 68/207 |
| 3,470,718 | 10/1969 | Scourtas . | |
| 3,478,373 | 11/1969 | McBride et al. . | |
| 3,478,374 | 11/1969 | McBride et al. . | |
| 3,498,090 | 3/1970 | Mason . | |
| 3,508,287 | 4/1970 | Mason | 68/207 |
| 3,948,064 | 4/1976 | Sauer et al. | 68/207 X |
| 4,144,749 | 3/1979 | Whitmore . | |
| 4,303,406 | 12/1981 | Ross . | |
| 4,335,592 | 6/1982 | Torita . | |
| 4,428,088 | 1/1984 | Getz et al. . | |
| 4,480,449 | 11/1984 | Getz et al. | 68/207 X |
| 4,503,575 | 3/1985 | Knoop et al. . | |

FOREIGN PATENT DOCUMENTS

| | | |
|---|---|---|
| 2034927 | 6/1980 | United Kingdom . |

*Primary Examiner*—Harvey C. Hornsby
*Assistant Examiner*—Frankie L. Stinson
*Attorney, Agent, or Firm*—Hill, Van Santen, Steadman & Simpson

[57] ABSTRACT

A liquid control system is provided for an automatic washer which responds to a user's input of fabric type to introduce into the tub of the washer an optimum volume of liquid to wash a clothes load in the tub based on sensed pressure wave changes as the tub is filled and agitated simultaneously.

18 Claims, 11 Drawing Figures

* COMMON PROCEDURE READS LEVEL AND COMPUTES AVERAGE LEVEL & RANGE WHILE WAITING EXITS TO MAIN PROGRAM.

LT-THRESHOLD LEVEL
EX-EXTRA WATER
LS-LEVEL TO SATISFY ALGORITHM
LR-LAST LEVEL CHECKED

* COMMON PROCEDURE READS LEVEL AND COMPUTES AVERAGE LEVEL AND RANGE WHILE WAITING EXITS TO MAIN PROGRAM.

CTR1 = COUNTER 1
CTR2 = COUNTER 2
LMN = MINIMUM LEVEL
LMX = MAXIMUM LEVEL
CTN = LEVEL COUNT
RNG = RANGE SUM
LCH = LEVEL CHANGE
LBS = BASE LEVEL
TEM = TEMPORARY STORAGE
LML = LAST MEAN LEVEL

PRESSURE SENSING AUTOMATIC WATER LEVEL CONTROL

BACKGROUND OF THE INVENTION

1. Field of the Invention

This invention relates to an automatic liquid control system for a clothes washing machine.

2. Description of the Prior Art

Various methods have been proposed in the past for controlling the amount of liquid added to a clothes washing machine to provide an optimum amount of wash liquid.

U.S. Pat. No. 3,086,836 discloses an automatic liquid level control wherein a given volume of liquid is added to the clothes load, the volume not absorbed by the clothes load is measured, and the measurement is utilized to determine the additional volume of liquid to be added to obtain the proper total amount of liquid.

U.S. Pat. No. 3,478,373 provides for an automatic liquid level control which responds to the flow of liquid in a predetermined flow path to sense when the proper amount of washing fluid is present in the tub of the washer.

U.S. Pat. No. 3,478,374 provides for an automatic liquid level control in an automatic washing machine which involves employing a sensing zone in proximity to the axis of the agitator, applying a reduced pressured at the sensing zone, and then introducing additional amounts of liquid into the machine when the liquid has been depleted from the sensing zone as a result of an excessive amount of wash fabric being present in comparison to the amount of washing liquid.

U.S. Pat. No. 3,498,090 utilizes a control system for use in automatic washers to automatically control the quantity of liquid added to the machine's tub during the wash and rinse operations by using a torque signal generated in the machine by action of the agitator.

U.S. Pat. No. 4,503,575 discloses an automatic water level control for an automatic washer which is responsive to various parameters selected by a user. An initial water volume is measured by a pressure transducer. An optimum volume is determined by computation from the initial minimum level volume, the fabric type and a stored table of optimum volumes.

SUMMARY OF THE INVENTION

The present invention provides in an automatic washer an automatic water level control to automatically control the amount of water in the washer based on the amount of clothes in the washer. Pressure sensing in the wash bath provides the necessary information. A pressure sensor is positioned within the automatic washer tub close to the bottom which provides a square wave output, the period of which is inversely proportional to pressure. The pressure is proportional to water level (head pressure) in the absence of agitation. With agitation, the period varies with both water level and water pressure waves caused by the agitator motion. The frequencies of these waves is double the agitator stroke rate (e.g. 120 strokes per minute produces a 240 cycles per minute or 4 Hz pressure wave). The phase depends on the position of the agitator blades with respect to the pressure sensor, whose output varies with these pressure waves. At the peak of the pressure wave, the period shortens slightly and at the valley of the pressure wave the period lengthens slightly. The difference of these two values is the variation or the range of the pressure signal. It has been found experimentally that the range changes as a function of both water level and clothes load The present invention makes use of this principle to estimate load size. By estimating the load size, the correct amount of wash liquid can be added to the wash tub for the washing cycle.

DESCRIPTION OF THE PREFERRED EMBODIMENTS

Figure 1:
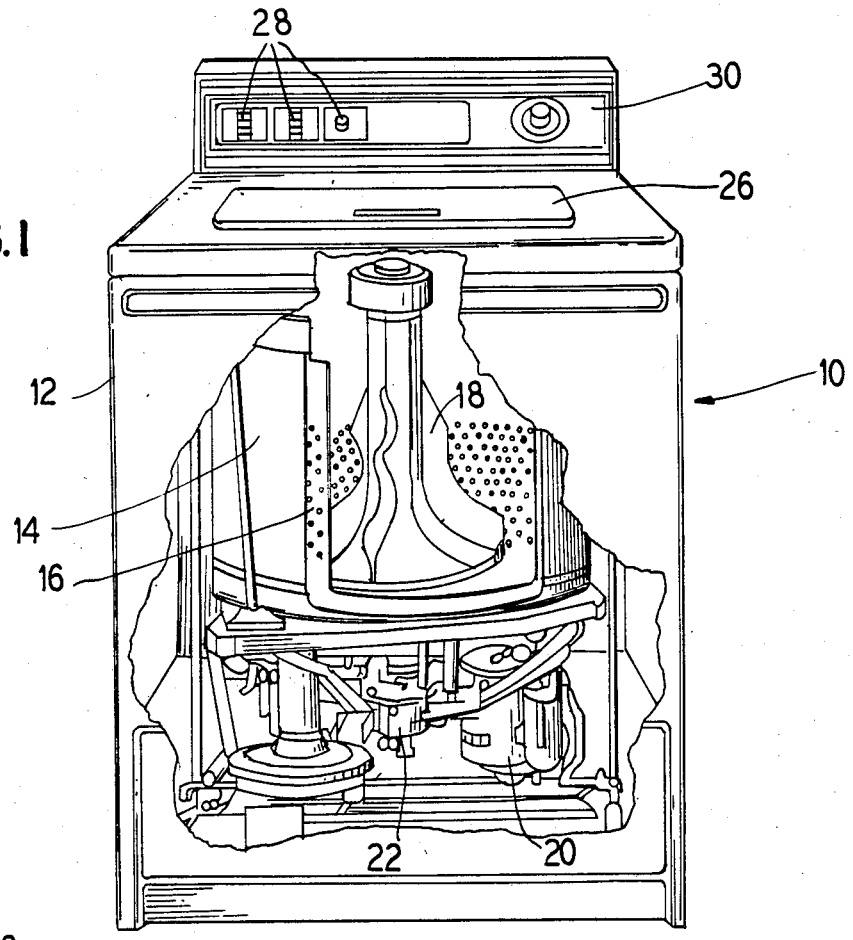
FIG. 1 is a perspective view of a vertical axis automatic washing machine partially cut away to show the interior workings thereof and containing the invention of the present application.

In FIG. 1, an automatic washing machine is shown generally at 10 comprising a cabinet or housing 12, an imperforate tub 14, a concentrically mounted basket 16 with a vertical agitator 18 including several equally-spaced blades, a water supply (not shown), and an electrically driven motor 20 operably connected via a transmission 22 to the agitator 18.

An openable lid 26 is provided on the top of cabinet 12 for access into the basket 16. Controls 28 including a presettable sequential control means for use in selectively operating the washing machine through a programmed sequence of washing, rinsing and drying steps are provided on a console panel 30.

Figure 2:
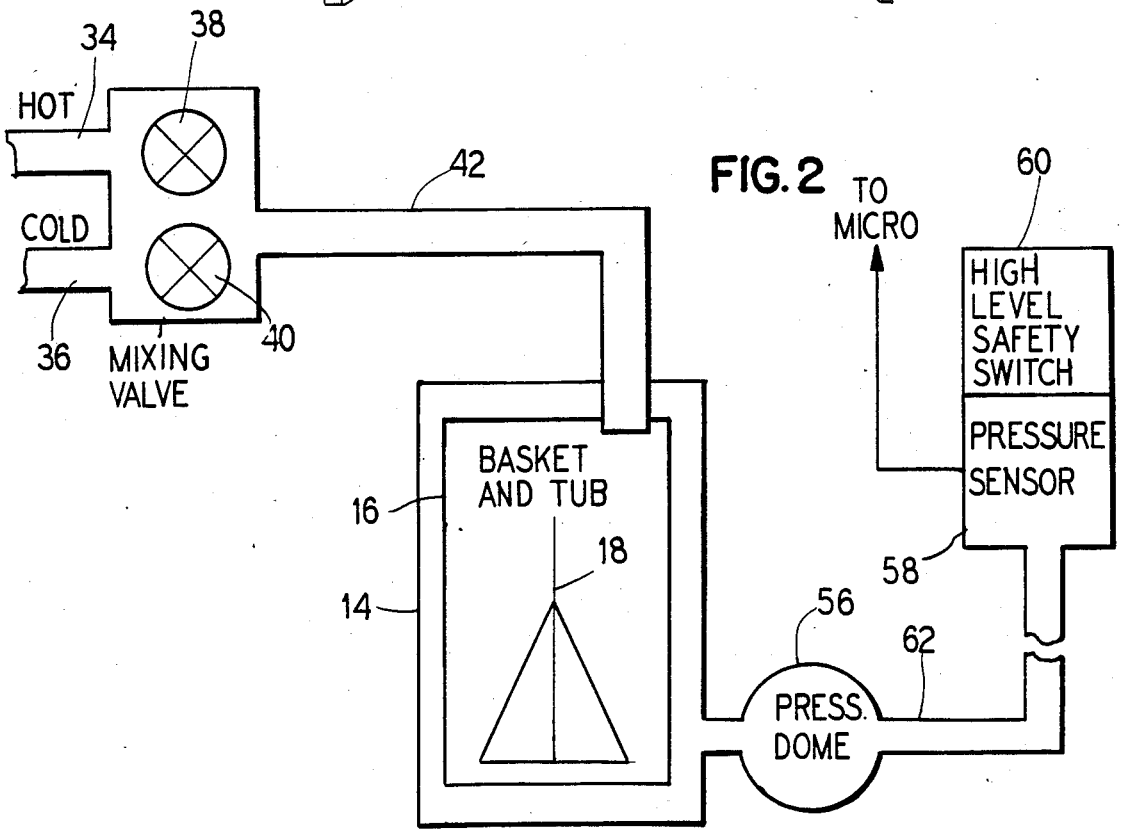
FIG. 2 is a schematic diagram showing a means for automatically filling the tub to a desired level with wash liquid.

FIG. 2 is a schematic diagram showing a means for automatically filling the wash tub 14 to a desired level with wash liquid. There is a hot water supply 34 and a cold water supply 36 which direct water to pass through mixing valves 38 and 40 to flow into water fill conduit 42. The mixing valves 38 and 40 are operated automatically by the washer controls in response to the temperature parameter selected by the user when operating controls 28. A pressure dome 56 is connected with the interior of the tub 14 near the bottom thereof to determine when a minimum liquid volume corresponding to a pre-determined liquid level is achieved within the tub 14. At the minimum level, the pressure within the pressure dome 56 operates a pressure sensor 58 which sends a signal to a micro computer. This minimum level signal is used to establish a point in time for measuring the water volume in the tub which is used in later calculations to determine a computed optimum water level for washing the clothes load.

The pressure dome 56 located on the side of the tub close to the bottom is connected by tubing 62 to the pressure sensor 58 which can be located in the console area 30. A high level safety switch 60 is provided to terminate the filling process if the water fill has not been terminated prior to water reaching the level required to move a pressure-sensing diaphragm in the switch housing, thereby to actuate switch 60, ending water fill. High level safety switch 60 may advantageously be located in a common housing with pressure sensor 58, with the switch actuating diaphragm (not shown) in communication with tubing 62. The pressure sensor 58 provides a square wave output, the period of which is inversely proportional to the sensed pressure. The sensed pressure is simply proportional to water level (head pressure) in the absence of any agitation. When agitation does occur, the period of the square wave output also varies with water pressure waves caused by the agitator motion. The frequency of the waves is double the agitator stroke rate and the phase depends on the position of the agitator blades with respect to the pressure sensor, whose output varies with the pressure waves.

Figure 3:
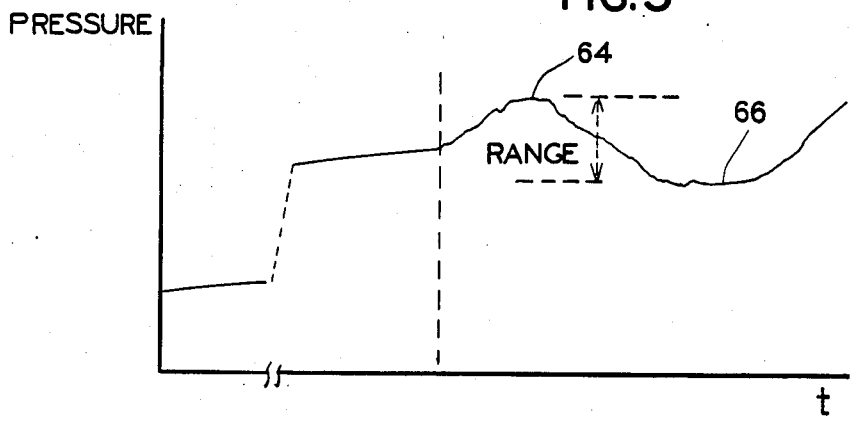
FIG. 3 is a graph showing the pressure value of the pressure waves over time.
Figure 4:
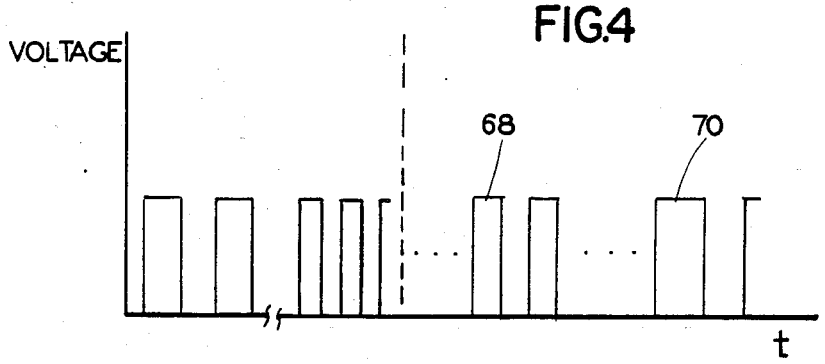
FIG. 4 shows the voltage output of the pressure sensor over time.

The relationship of the pressure waves is shown in an exaggerated form in FIG. 3. A peak 64 of the pressure wave is shown to be substantially elevated over a valley 66 of the pressure wave. FIG. 4 illustrates the square wave output of the pressure sensor 58 and it can be seen that since FIGS. 3 and 4 are shown in an identical time relationship, a square wave 68 corresponding in time to the peak 64 has a lesser period than does a square wave 70 which corresponds to the trough 66. Thus, at the peak 64 of the pressure wave, the period of the square wave shortens slightly and at the valley 66 of the pressure wave, the period of the square wave lengthens slightly.

Figure 5:
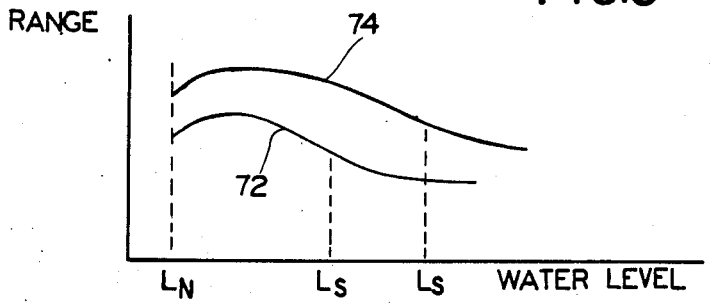
FIG. 5 is a graphic illustration of the rate change as a function of water level for two different size loads.

The difference of these two values is the variation or range of the pressure signal. It has been found experimentally that the range changes as a function of both water level and clothes load. FIG. 5 illustrates the range change as a function of water level for two different size loads. A curve 72 illustrates a small clothes load and a curve 74 illustrates a large clothes load. As illustrated in FIG. 5, the range of pressure differentials of the water head pressure diminishes with the addition of water to the tub with both a small clothes load and a large clothes load. That is, for the smaller clothes load (72) with a small water to clothes ratio, the range is large, but diminishes with additional water. The larger load (74) has this decrease in range at a higher water level. The present invention makes use of this principle to estimate load size.

In FIG. 5, $L_N$ denotes the minimum water level, and LS denotes for each curve the water level at the switch point i.e. when the algorithm for the present invention is satisfied as will appear.

Figure 6:
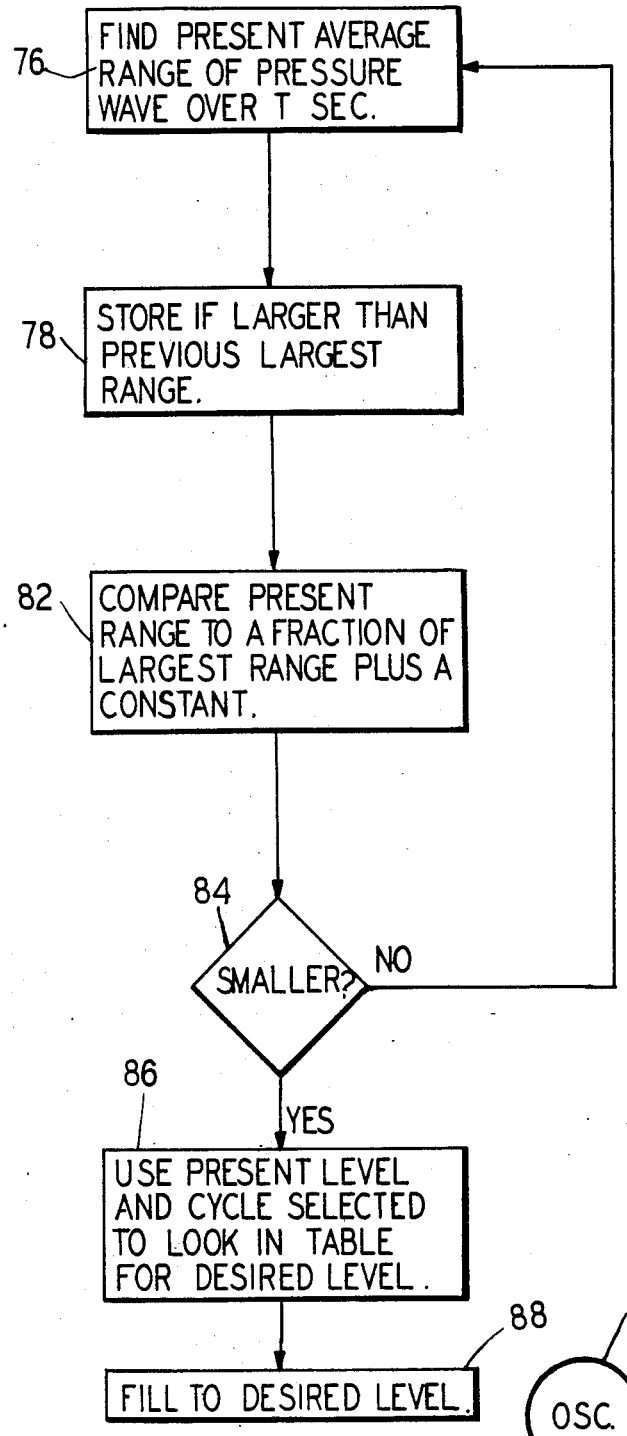
FIG. 6 is a flow chart of steps undertaken by a control circuit following the principles of the present invention.

FIG. 6 illustrates a simplified series of steps undertaken by the control circuit embodying the principles and the algorithm of the present invention.

Control unit 76 determines the present average range of the pressure wave over a period of T seconds. Control is then passed to control unit 78 which stores the present average range as the largest range if it is larger than the previous largest stored pressure range. Control is then passed to control unit 82 which compares the present range to a predetermined fraction of the largest sensed pressure (e.g. $\frac{3}{4}$ of the largest sensed pressure) plus a previously determined and experimentally derived constant. If the present average range is not less than a predetermined fraction of the largest average range plus the predetermined constant, then control unit 84 passes control back to control unit 76 where a new average range is found and the procedure is repeated. If, however, the present average range is less than a predetermined fraction of the largest average range plus the constant, then this means that the water level in the tub has increased sufficiently to cause the range to decrease as illustrated in FIG. 5 to a water level which has been experimentally determined to be at a certain known point. Control is then passed to control unit 86 which uses the present level and cycle selected to look into an experimentally derived performance table for the optimum water level for a given load size and fabric type. For example, control unit 84 may be satisfied at 40 liters of water (which may indicate a two pound cotton load). The table may contain a value of 50 liters for this 40 liter initial fill and a regular/cotton cycle. Control would then be passed to control unit 88 so that an additional 10 liters (in this case) would be added to the tub.

A modification of the invention providing an alternative to control 78 utilizes storage of the average of the first few ranges as the initial ranges and control unit 82 then compares the present range to a fraction of the initial range plus a constant.

Figure 7:
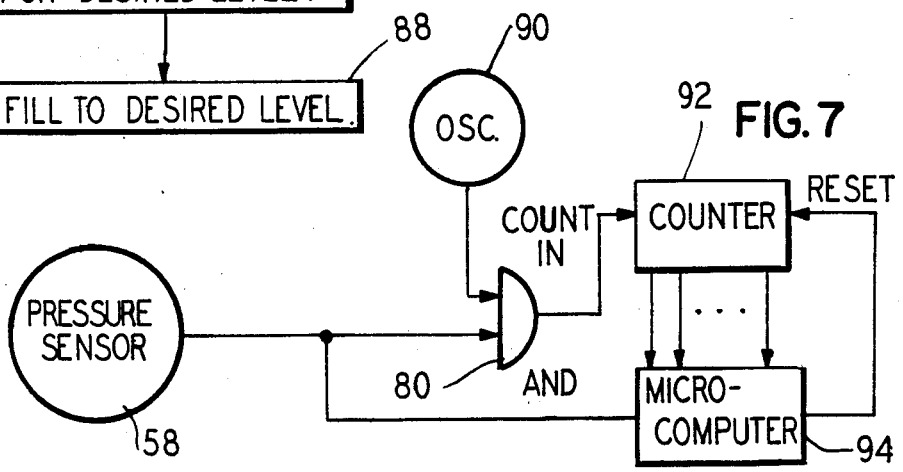
FIG. 7 is a schematic illustration of some of the hardware utilized in the control system of the present invention.

FIG. 7 is a schematic illustration of the hardware elements used to detect and determine the pressure range. The pressure sensor 58 sends the square wave to an AND gate 80 at the same time a square wave from an oscillator 90 is received at gate 80 whose output goes go a 14 bit counter 92. The pressure sensor output is also used by the micro computer 94 to signal the micro computer after the sensor signal goes low, to read and reset the counter 92. The raw counts are used during the steps shown in FIG. 6 to find level and pressure range.

Figure 8A:
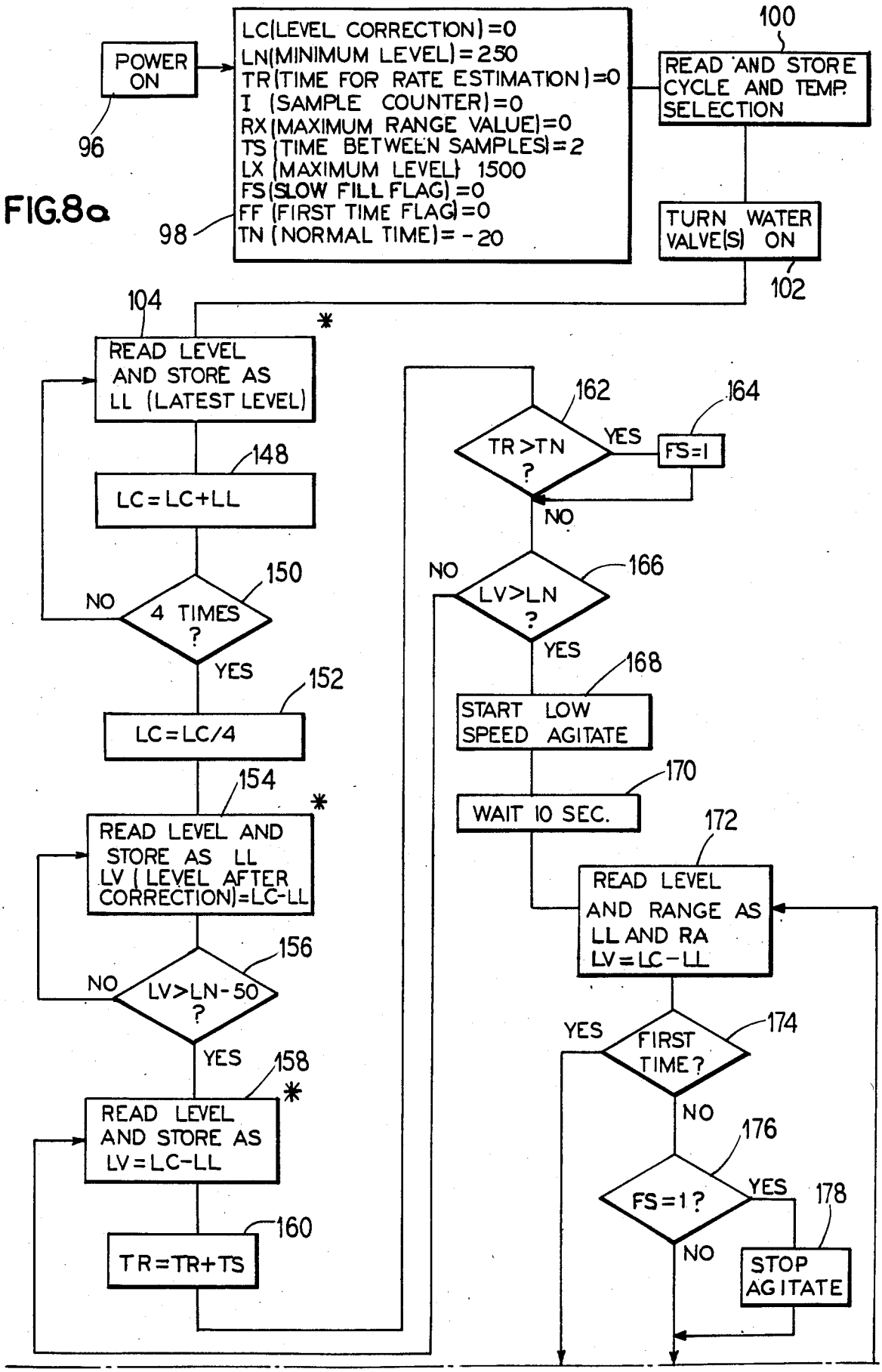
FIGS. 8*a*, 8*b* and 8*c* are a detailed flow chart illustrating the steps followed by the present invention.
Figure 8B:
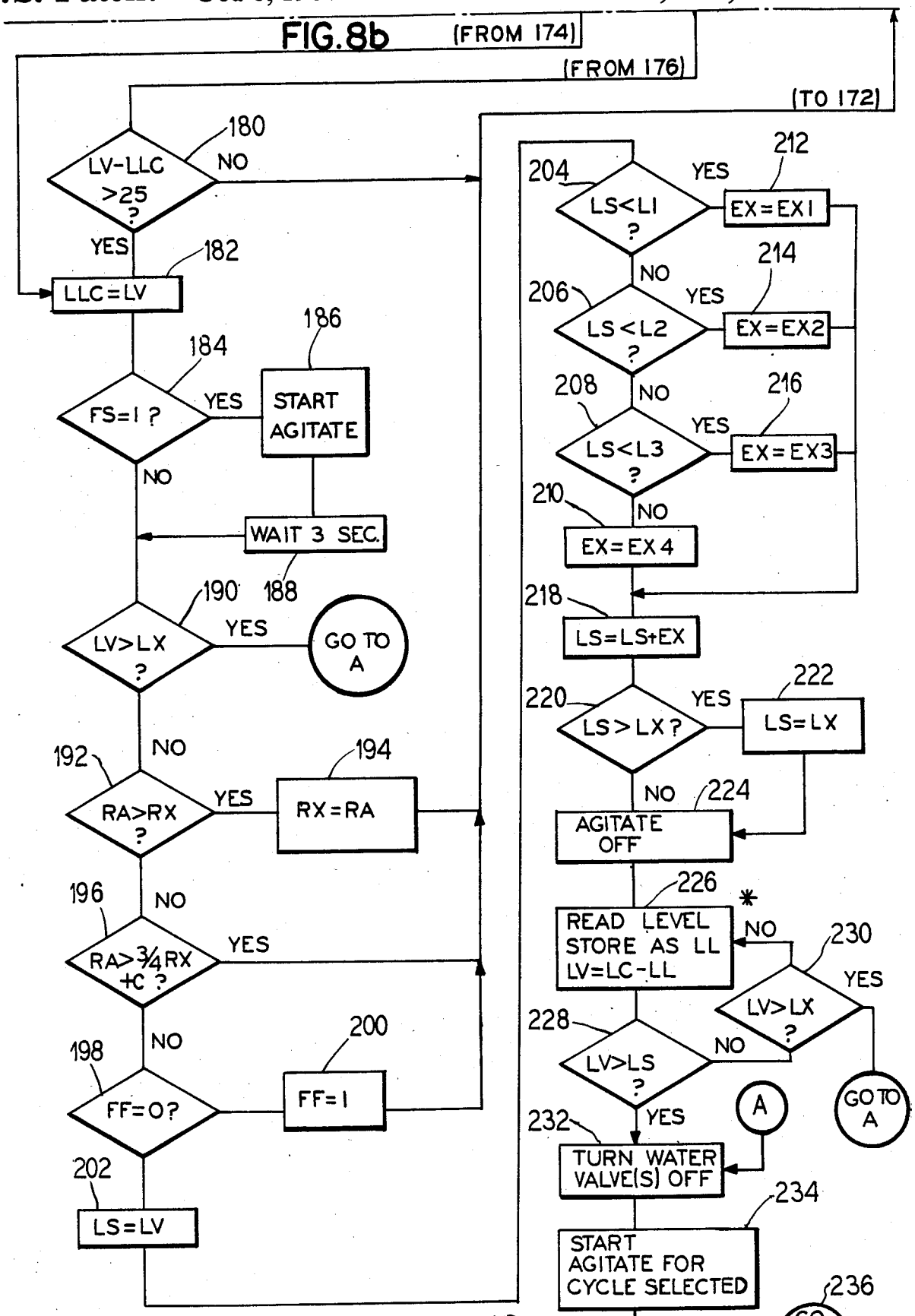
Figure 8C:
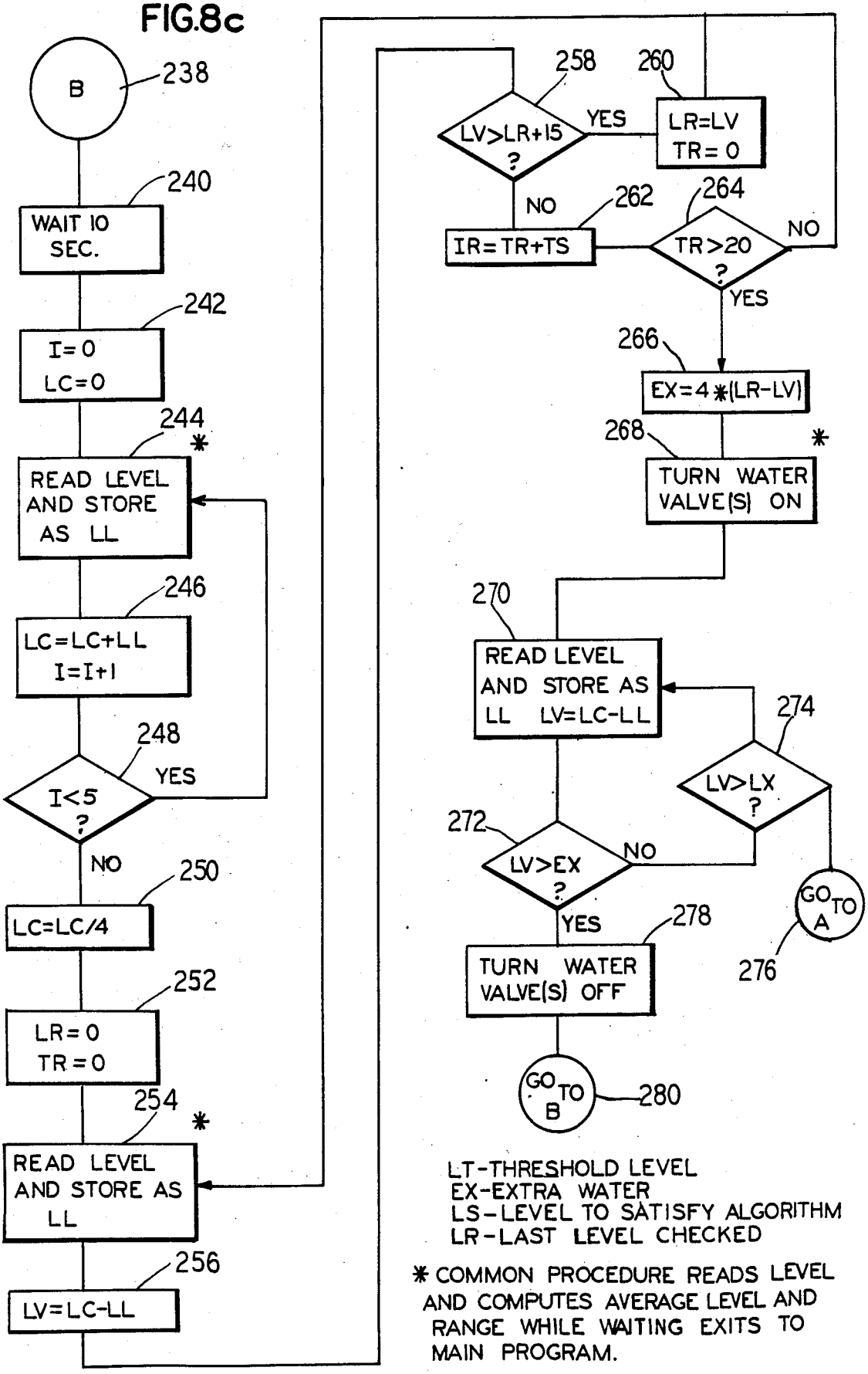

FIGS. 8*a*, 8*b* and 8*c* illustrate a detailed flow chart for the control embodying the principles of the present invention.

Power is turned on in control unit 96 and control is then passed to control unit 98 where the listed variables are initialized. Control is passed to control unit 100 where the cycle and temperature selection are read from the control panel and stored. Control then passes to control unit 102 which turns the required water valve(s) to open. Control is passed to control unit 104 where the water level is read and stored as LL. An asterisk is shown adjacent to control unit 104 which indicates that the common procedure shown at FIG. 9 is used.

Figure 9:
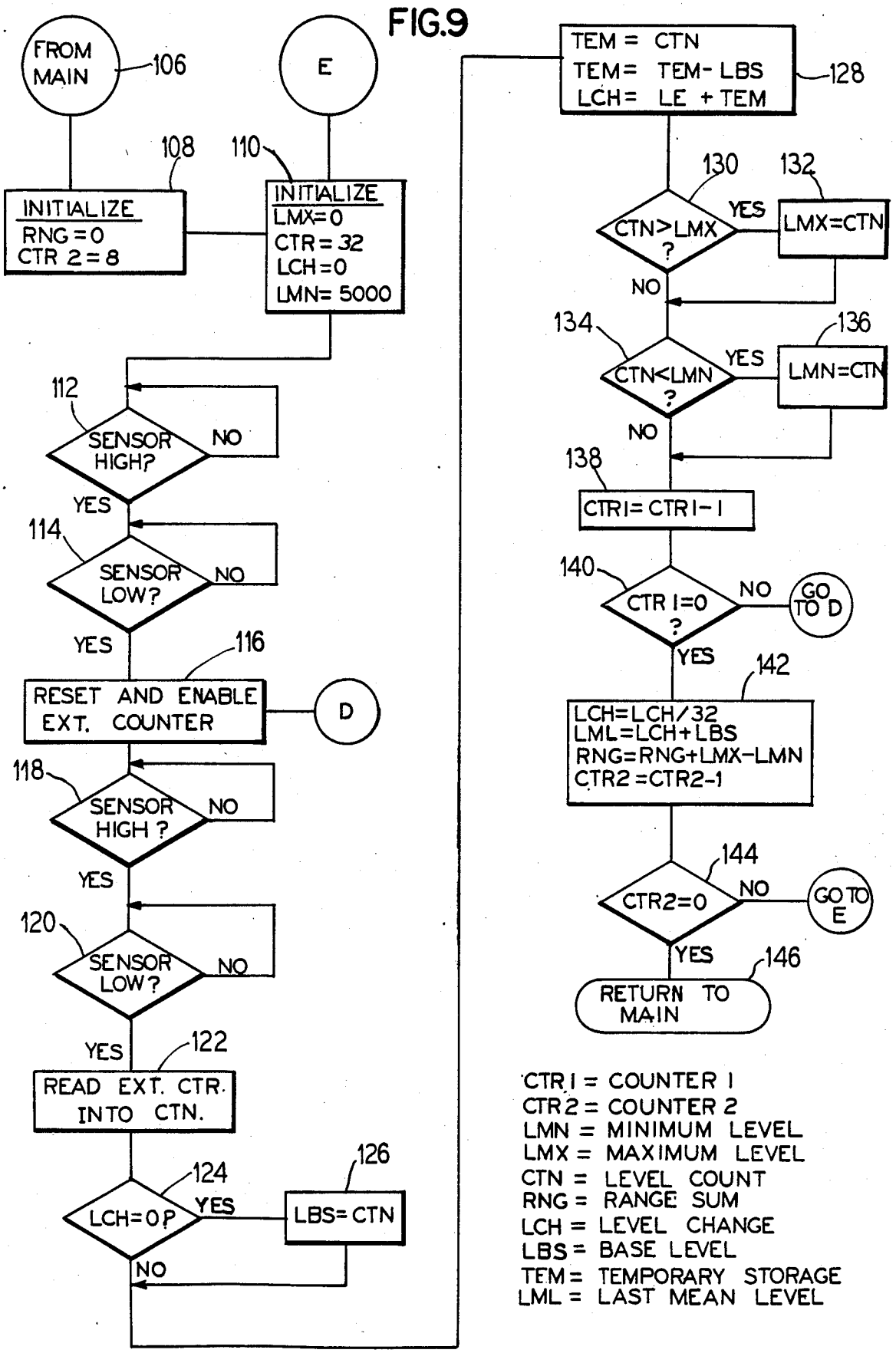
FIG. 9 is a flow chart of a common sub-routine utilized during the main program as indicated by asterisks in FIGS. 8*a*, 8*b* and 8*c*.

Referring to FIG. 9, control is passed through control unit 106 from the main program to control unit 108 where some variables are initialized. Control is then passed to control unit 110 where additional variables are initialized. Control then passes to control unit 112 which determines if a high voltage level for the sensor 58 is detected. Control is repeatedly passed back to control unit 112 until a high voltage level is detected. When this occurs, control is passed to control unit 114 which determines if a low voltage level is detected. Control is returned to control unit 114 until a low level is detected. When this occurs, control is then passed to control unit 116 at the low level which assures starting from a known point.

At this point, the counter is reset and is enabled. Control then passes to control unit 118 where again it is determined if there is a high level being sensed. Control is kept at control unit 118 until a high level is sensed. When this occurs, control is passed to control unit 120 and is held at control unit 120 until a low pressure is sensed, during which time the counter is being incremented from the oscillator 90. At this point, control is then passed to control unit 122 which stores the output of the counter as a level count. Control then passes to control unit 124 to determine if the level change is zero (which occurs only on the initial pass). If the level change is zero then control is passed to control unit 126 where the stored level count is also stored as the base level. If the level change is not zero, or after the level count has been stored as the base level, control is passed to control unit 128 which stores a new level change which is the difference between the level count and the base level. Control is then passed to control unit 130 where it is determined whether the level count is less than the maximum level. If the level count is greater than the maximum then control is passed to control unit 132 where the maximum level is reset to equal the level count. If the level count is not less than the maximum level, or after the maximum level has been set equal to the level count, then control is passed to control unit 134 where it is determined whether the level count is less than the minimum level.

If the level count is determined to be less than the stored minimum level then control is passed to control unit 136 where the minimum level is reset to be equal to the level count. If the level count is not less than the minimum level, or after the minimum level has been reset to be equal to the level count, then control is passed to control unit 138 where the first counter is decreased by one. Control then passes to control unit 140 where it is determined whether the first counter has reached zero. If rhe counter has not reached zero, then control is passed back to control unit 116 to repeat the previously described steps.

Once the first counter does reach zero, then control is passed to control unit 142 which calculates an average level change, stores a last mean level, stores a range sum and decreases the second counter by one. Control then passes to control unit 144 to determine whether the second counter has reached zero. If the second counter has not yet reached zero then control is passed back to control unit 110 to repeat the steps previously described. If the second counter has reached zero then control is passed to control unit 146 which returns the control to the main program.

Thus it is seen that this common sub-program reads the counts from the counter which counts the number of high frequency pulses during each positive half cycle of the sensor output. The output of this routine is the mean level for the last 32 samples and the total range for the 8 groups of 32 samples.

Returning to FIG. 8*a*, after the level has been read in control unit 104 and has been stored as the latest level, control is passed to control unit 148 which sums the level correction value and the latest level. Control then passes to control unit 150 which determines whether four levels have been summed. If not, control is returned back to control unit 104 for repetition of the above steps. If this procedure has occurred four times, then control is passed to control unit 152 which calculates an average level correction value which is used to correct all subsequent level values for the level count when there is no water pressure.

Control is then passed to control unit 154 in which the level is again read and stored as the latest level. A level after correction is calculated and stored. Control is then passed to control unit 156 which determines if the level after correction value is greater than the minimum level less a constant which is shown as 50. If the level is not greater than the predetermined level, then control is returned to control unit 154 for repetition of the steps until the level after correction is greater than the predetermined level. When this occurs, control is passed to control unit 158 where the level is again read and stored as a corrected level.

Control then passes to control unit 160 which accumulates the time for rate estimation. Control then passes to control unit 162 where it is determined whether the time for rate estimation is greater than the normal time. If the time for filling a given amount is greater than the normal time then control is passed to control unit 164 wherein the slow fill flag is set to one. If the time for filling is not greater than the normal time, or after the time flag has been set to one then control is passed to control unit 166 where it is determined whether the level after correction is greater than the minimum level. If the level after correction is not greater than the minimum level, then control is passed back to control unit 158 for repetition of the above steps.

Once the level after correction is greater than the minimum level, then control is passed to control unit 168 which causes the washer to begin a low speed agitation of the clothes load with wetting of the clothes. Control then passes to control unit 170 which causes a delay in order to permit the washer to achieve an equilibrium in the agitation of the clothes load.

It is seen that at this point in the wash cycle, a base value, that is the difference between the present level and the base value is used to correct for variations and sensor outputs. A minimum level of wash water is found and an approximate flow rate is computed. If the flow rate is too slow a flag is set which will be used to stop agitation until a certain level is attained to reduce possible fabric abrasion for low water levels and long fill times.

After the delay occassioned by control unit 170, control is passed to control unit 172 where the level is again read and the level and range are stored. Control is then passed to control unit 174 which determines if this is the first time that the wash cycle has reached this point. If it is not, then control is passed to control unit 176 which determines whether the slow fill flag has been set to one. If the flag has been set to one, then control is passed to control unit 178 to stop the agitation. If the slow fill flag has not been reset to one or after agitation has been stopped, then control is passed to control unit 180 where it is determined if the level after correction less LLC is greater than a predetermined constant shown as 25. If this determination is affirmative, then control is passed to control unit 182 which sets the LLC equal to the level after correction.

Referring back to control unit 174, if this is the first time that control has passed to control unit 174, then control is passed directly to control unit 182 where the LLC is set equal to the level after correction. In any event, control then passes to control unit 184 where it again is checked to see if the slow fill flag has been set to one. If the flag has been set, then control is passed to control unit 186 for resumption of agitation. Control then passes to unit 188 for a predetermined amount of time shown as 3 seconds. If the slow fill flag has not been set, or if after the resumption of agitation, then control is passed to control unit 190.

Referring back to control unit 180, if the level after correction less LLC is not greater than the predetermined value, then control is also passed directly to control unit 172 to read another level and range.

In any event, control is then passed to control unit 190 where it is determined whether the level after correction is greater than the maximum level. If this determination is negative, then control is passed to control unit 192 which determines whether the stored range is greater than the maximum range value. If this determination is affirmative, then control is passed to control unit 194 where the maximum range value is reset to the stored range value and control is then passed back to control unit 172 for repetition of the above steps.

If the stored range is not greater than the maximum range, then control is passed from control unit 192 to control unit 196 where it is determined whether the stored range is greater than a predetermined fraction such as three quarters of the maximum range plus a predetermined constant such as 5. If this determination is affirmative, then control is again passed back to control unit 172 for repetition of the above steps. If the stored range is not greater than ¾ths of the maximum range plus a predetermined constant, then control is passed to control unit 198 where it is determined if the first time flag is equal to zero. If this determination is affirmative, then control is passed to control unit 200 which sets the first time flag to one and again passes control back to control unit 172 for repetition of the above steps. If the first time flag is not equal to zero, then control is passed from control unit 198 to control unit 202 which resets the LS value equal to the level after correction.

It is seen that the portion of the program between control unit 172 and control unit 202 finds a level of liquid within the tub which satisfies the automatic water level control algorithm of the present invention (that is where the current range is ¾ths of the maximum previous range plus a constant).

Control is then passed to control unit 204 which determines whether the level selected is less than L1. If the determination is negative, then control is passed to control unit 206 where it is determined whether the LS value is less than L2. If this determination is negative then control is passed to control unit 208 where it is determined if LS value is less than L3. If this determination is negative then control is passed to control unit 210 where the extra water amount is set equal to a predetermined stored value EX4.

If the determination in control unit 204 had been affirmative, then control would have been passed to control unit 212 where the extra water value would have been set to a first previously determined value EX1. If the determination in control unit 206 had been affirmative then control would have been passed to control unit 214 where the extra water value would have been set at a predetermined value EX2. If the determination in control unit 208 had been positive then control would have been passed to control unit 216 where the extra water value would have been set at a predetermined value EX3. In any event, after the extra water value had been set, control is passed to control unit 218 where the level LS is set to the previously set value plus the extra water value which has been determined.

Control is then passed to control unit 220 where it is determined if the optimum level is greater than the maximum level for a full tub. If this determination is affirmative, then control is passed to control unit 222 where the optimum value is reset to a full tub value. If the optimum value is not greater than the value for a full tub, or after the optimum value has been reset to the level of the full tub, then control is passed to control unit 224 where the agitation is terminated.

Control is then passed to control unit 226 where the level is again read and a new level after correction is calculated. Control is then passed to control unit 228 which compares the level after correction with the optimum level to determine if it is greater than the optimum level. If the determination is negative, then control is passed to control unit 230 to determine if the level after correction is greater than the maximum level. If this determination is negative then control is passed back to control unit 226 for repetition of the above steps. If the level after correction is greater than the optimum level as determined by control unit 228 or if the level after correction is greater than the maximum level determined by control unit 230, then control is passed to control unit 232 where the water valves are turned off.

Referring back to control unit 190, if the level after correction had been determined there to be greater than the maximum level, then control would have been passed directly to control unit 232 to turn the water valves off. Control is then passed to control unit 234 to start the agitation cycle selected.

It is seen that the portion of the program between control unit 204 and control unit 234 uses a "table lookup" to find the amount of extra water needed for the particular load size which has been measured. This table could also be a function of other variables such as fabric type. The extra water is then added and the correct agitation rate is started.

Control is then passed to control unit 236 which causes the program to continue onto the portion illustrated in FIG. 8*c* at control unit 238. Control is then passed to control unit 240 which causes a fixed delay, for example of ten seconds, then control is passed to control unit 242 where two variables are reset to zero.

Control is then passed to control unit 244 where the level is read according to the series of steps between control units 106 and 146. Control is then passed to control unit 246 where the level correction is recalculated and a counter is increased. Control is then passed to control unit 248 where it is determined whether the counter is still less than 5. If this determination is affirmative then control is passed back to control unit 244 for repetition of the above steps. If the determination is negative then control is passed to control unit 250 and an average level correction is calculated. Control is then passed to control unit 252 where two other variables are reset to zero. Control is then passed to control unit 254 where the water level is again read according to the steps of control units 106 through 146. Control is then passed to control unit 256 where a new level after correction is calculated. Control then passes to control unit 258 where it is determined whether the level after correction is greater than the maximum level plus a predefined constant, shown here as 15. If this determination is affirmative, then control passes to control unit 260 where the maximum level value is reset to be equal to the level after correction value and the time for rate estimation is reset to zero. Control then passes back to control unit 254 for repetition of the above steps.

If the determination at control unit 258 is negative, then control passes to control unit 262 where the time for rate estimation is reset to be the sum of the previous time for rate estimation plus a value for time between samples. Control then passes to control unit 264 where it is determined whether the new time for rate estimation is greater than a predetermined constant such as 20. If this determination is negative, then control passes back to control unit 254 for repetition of the above steps. If the determination in control unit 264 is affirmative, then control passes to control unit 266 where an extra water value is calculated. Control then passes to control unit 268 where the water valves are turned on. Control next passes to control unit 270 where the water level is again read according to the steps set forth by control units 106 through 146 and a new level after correction is calculated. Control then passes to control unit 272 where it is determined whether the level after correction exceeds the extra water value. If this determination is negative, then control passes to control unit 274 to determine if the level after correction exceeds the maximum level. If this determination is negative then control is passed to control unit 270 for repetition of the above steps. If the determination in control unit 274 is affirmative, then control passes by means of control unit 276 back to control unit 232 for repetition of the above steps.

If the determination in control unit 272 had been affirmative, then control would be passed to control unit 278 where the water valves are turned off. Control then passes by means of control unit 280 back to control unit 238 for repetition of the above steps.

It is seen that the program between control units 238 and 264 finds a new base level and checks to see if the water raises a given amount from this level. If so, the control measures the amount and calculates the volume of additional water to add. The portion of the control from control unit 266 through control unit 280 adds the volume of additional water.

Thus, it is seen that there are several advantages which are provided by the present invention. First, there is a calculation of a base value, that is with no water, which corrects for differences between sensors, oscillator frequencies and other hardware. Also, the amount of agitation at low water levels and the attendant possible clothes damage is minimized with no agitation up to a first minimum level (which may be approximately 35 liters) and the stoppage of agitation between samples if the water flow rate is low.

Further, additional water is added after the algorithm is satisfied to give desirable water levels for that load and fabric type. Also, clothes added after filling can be detected (if two pounds or more) and additional water can then be added. Also, all clothes could be added after the filling step.

Overfilling is prevented in two ways: First, by checks during fill utilizing control block 190 and second, by high level safety switch 60.

As is apparent from the foregoing specification, the invention is susceptible of being embodied with various alterations and modifications which may differ particularly from those that. have been described in the preceeding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. An automatic washing machine having a tub to receive washing liquid and a load of clothes to be washed therein including an automatic liquid fill control system comprising:

supply means for supplying wash liquid to said tub;

means for measuring the head pressure of liquid in said tub;

means for agitating said liquid in said tub in an oscillatory manner to create pressure waves;

means for measuring the varying pressure of said pressure waves;

means for determining and storing the range of varying pressures of said pressure waves;

means for comparing a currently determined range with a stored largest range;

means for determining the optimum total volume of liquid required for washing said clothes load based on the pressure range comparison, and means for automatically controlling said supply means for admitting desired volumes of water into said tub.

2. A device according to claim 1 including means for measuring the rate at which liquid is being supplied to the tub during agitation and means for interrupting and restarting agitation to permit additional liquid to be supplied to the tub without agitation during periods of low liquid levels and long fill times.

3. A device according to claim 1, wherein said means for measuring the head pressure and means for measuring the varying pressure of the pressure waves comprises means for sampling the pressure of the liquid exerted against a portion of said tub.

4. A device according to claim 1, wherein said means for automatically controlling said supply means includes means for controlling valves in water supply lines connected to said tub.

5. A device according to claim 1 including means for inputting fabric type of said clothes load.

6. A device according to claim 5, wherein said means for determining the optimum total volume of liquid requirement for wash said clothes load is dependent on said pressure range comparison and said fabric type.

7. A device according to claim 1, wherein said means for measuring the varying pressures comprises a pressure sensor which provides an electrical square wave output having a period inversely proportional to the pressure sensed.

8. A device according to claim 7, wherein said means for determining a range of pressures includes means for determining the period of said electrical square waves.

9. In a machine for liquid treatment of materials a liquid control system comprising:

a container for receiving said materials;

means for adding liquid to said container;

means for determining the amount of liquid added to said container;

means for agitating said liquid in said container to cause pressure waves;

means for determining and storing the range of varying pressures of said pressure waves;

means for comparing a current range with a previously stored largest range;

means for determining an optimum value of additional liquid to be added based on the amount of liquid previously added and differences in pressure ranges; and means for introducing said additional liquid into said container.

10. A system according to claim 9, wherein said means for agitation comprises a vaned oscillating vertical axis agitator.

11. A device according to claim 9 including means for measuring the rate at which liquid is being supplied to the tub during agitation and means for interrupting and restarting agitation to permit additional liquid to be supplied to the tub without agitation during periods of low liquid levels and long fill times.

12. A device according to claim 9, wherein said means for measuring the head pressure and means for measuring the varying pressure of the pressure waves comprises means for sampling the pressure of the liquid exerted against a portion of said tub.

13. A device according to claim 9, wherein said means for automatically controlling said supply means includes means for controlling valves in water supply lines connected to said tub.

14. A device according to claim 9 including means for inputing fabric type of said clothes load.

15. A device according to claim 14, wherein said means for determining the optimum total volume of liquid requirement for wash said clothes load is dependant on said pressure range comparison and said fabric type.

16. A device according to claim 9, wherein said means for measuring the varying pressures comprises a pressure sensor which provides an electrical square wave output having a period inversely proportional to the pressure sensed.

17. A device according to claim 16, wherein said means for determining a range of pressures includes means for determining the period of said electrical square waves.

18. A method of controlling the amount of liquid in a liquid treatment machine comprising:

placing a specific mass of material to be treated in a container in the machine;

filling the machine with liquid;

agitating the material and liquid in the container during the filling step in an oscillatory manner;

measuring the head pressure of the liquid during the agitating step;

determining and storing the range of pressures during periods of oscillation;

comparing a current range with a previously stored largest range;

calculating an optimum value of additional liquid to be added based on the amount of liquid in the container and the differences in pressure ranges, and introducing additional liquid in an amount to achieve said optimum value.

* * * * *